US006145721A

United States Patent [19]

Gately

[11] Patent Number: 6,145,721

[45] Date of Patent: Nov. 14, 2000

[54] WAIST PACK FOR CARRYING FOOTWEAR, IN PARTICULAR IN-LINE OR OTHER SKATES

[76] Inventor: Stephen R. Gately, 164 Normandy Hill Dr., Alexandria, Va. 22304

[21] Appl. No.: 09/351,006

[22] Filed: Jul. 12, 1999

[51] Int. Cl.[7] ..... A45C 1/04

[52] U.S. Cl. ..... 224/680; 206/278; 224/250; 224/625; 224/660; 224/676; 224/682

[58] Field of Search ..... 224/680, 676, 224/625, 660, 664, 682, 684, 250; 206/278

[56] References Cited

U.S. PATENT DOCUMENTS

| | | |
|---|---|---|
| D. 361,889 | 9/1995 | Rhines . |
| D. 382,110 | 8/1997 | Pollari . |
| 2,428,074 | 9/1947 | Hanson . |
| 4,018,369 | 4/1977 | Jaeger . |
| 4,337,883 | 7/1982 | Pate . |
| 4,483,470 | 11/1984 | Cousins . |
| 4,863,083 | 9/1989 | Chen . |
| 4,982,883 | 1/1991 | Ullal et al. . |
| 5,285,939 | 2/1994 | Hogan . |
| 5,450,991 | 9/1995 | Neading . |
| 5,456,353 | 10/1995 | Challoner et al. . |
| 5,492,254 | 2/1996 | Challoner et al. . |
| 5,509,589 | 4/1996 | Kliot . |
| 5,570,824 | 11/1996 | Lyon et al. . |
| 5,582,337 | 12/1996 | McPherson et al. . |
| 5,642,842 | 7/1997 | Taras . |
| 5,664,719 | 9/1997 | Bigham et al. . |
| 5,690,261 | 11/1997 | Moore . |
| 5,785,220 | 7/1998 | Leddy . |
| 5,826,771 | 10/1998 | Peng . |

OTHER PUBLICATIONS

IBM—Intellectual Property Network Database Search Report (9 pages).

*Primary Examiner*—Gregory M. Vidovich
*Assistant Examiner*—Maerena W. Brevard
*Attorney, Agent, or Firm*—Dinesh Agarwal, P.C.

[57] ABSTRACT

A waist pack for carrying footwear, in particular in-line or other skates, includes a waist strap with left and right waist sections each including a narrow belt section and a wider belt section. Left and right footwear carrying assemblies are connected to the respective left and right waist sections for holding, for example, in-line skates. The left and right footwear carrying assemblies include first and second support straps each including a first end connected to the corresponding wider belt section and a free end. One of the first and second support straps includes a wider portion for extending about the footwear and a first fastener for cooperating with another fastener at the other of the first and second support straps.

20 Claims, 5 Drawing Sheets

WAIST PACK FOR CARRYING FOOTWEAR, IN PARTICULAR IN-LINE OR OTHER SKATES

FIELD AND HISTORICAL BACKGROUND OF THE INVENTION

The present invention is directed to a device for carrying footwear, and more particularly to a waist pack for carrying in-line or other skates.

There has been an exploding interest in outdoor activities in recent times. Various new outdoor sports are now part of the daily lives of teenagers and adults alike. Some of these activities include roller blading, skate boarding, snow boarding, etc. While snow boarding and the like require a very specific environment and terrain and necessitate taking the time away from daily routine, other activities, such as roller blading, can be easily incorporated in a person's daily life. For example, many active roller blading participants frequently combine roller blading with daily routine activities, such as shopping at nearby malls, entertaining at local restaurants, and the like. Although it is very desirable to combine the roller blading activity with a trip to a nearby mall or restaurant, it poses a problem in that at the end of the roller blading activity, the skater must switch to regular walking shoes for the skates or roller blades, when walking, for example, inside a mall or restaurant, or the like. As a result, it is often necessary to carry an extra pair of regular or walking shoes while skating, and then carry the rather bulky skates when regular walking is resumed. Frequently, the skaters simply tie the shoe strings of the regular shoes together and sling the shoes over the shoulder. And, when the regular shoes are substituted for skates, the skates are somehow fastened together and either slung over the shoulder or carried in hands. The carrying of the regular shoes, or the skates over the shoulder or in hands, poses a problem as they interfere with free movement of the skater about the mall, restaurant, etc, and may lead to contamination of the skater's clothing due to any dirt that may have collected on the skates during the skating activity.

In addition, the carrying of the regular shoes over the shoulder interferes with a proper and safe participation in the skating activity since skating requires proper balance and movement of the arms and legs in coordination with each other to achieve an enjoyable and safe wheeling on the skates. It is therefore important and desirable to keep the skater's arms and shoulders free of any obstruction to achieve proper balance. Moreover, the free slinging of the shoes over the skater's shoulder may pose a threat to other skaters and non-skaters alike since skating, and in particular roller blading, is done on sidewalks, paved streets, or the like, and on occasion, at fairly high speeds.

Various devices for carrying skates and other sport equipment have been proposed in the art as shown in U.S. Pat. Nos. 2,428,074; 4,018,369; 4,337,883; 4,483,470; 4,863,083; 4,982,883; 5,285,939; 5,450,991; 5,456,353; 5,492,254; 5,509,589; 5,570,824; 5,582,337; 5,642,842; 5,664,719; 5,690,261; 5,785,220; 5,826,771; Des.361,889; and Des.382,110.

However, there remains a need in the industry for a waist pack for carrying footwear, particularly in-line or other skates, which allows a skater to comfortably carry either the regular footwear or the skates with minimal interference while engaging in both skating and non-skating activities.

OBJECTS AND SUMMARY OF THE INVENTION

The principal object of the present invention is to provide a waist pack for carrying footwear which allows a skater to carry both the regular shoes and skates without interference in the skating or a non-skating activity.

Another object of the present invention is to provide a waist pack for carrying footwear which provides an easy means for carrying regular shoes during skating, and which does not interfere with the movement of the skater's arms or shoulders for achieving a proper balance during the skating activity.

Yet another object of the present invention is to provide a waist pack for carrying footwear that is lightweight, easy to use, and which securely and snugly carries the skates about the waist of the user.

Still yet another object of the present invention is to provide a waist pack for carrying footwear which is constructed and designed to be directly supported on the waist of a user to minimize straddling and for better portability and comfort.

An additional object of the present invention is to provide a waist pack for carrying footwear which is versatile in that it can be used for carrying different sizes of shoes and skates.

In summary, the main object of the present invention is to provide a waist pack for carrying footwear, particularly in-line skates and regular shoes, which allows a skater to comfortably and safely carry regular shoes and skates, without interference in free movement of hands, etc, both during walking and skating.

In accordance with the invention, a waist pack for carrying footwear, in particular in-line or other skates, includes a waist strap with left and right waist sections each including a narrow belt section and a wider belt section. Left and right footwear carrying assemblies are connected to the respective left and right waist sections for holding, for example, in-line skates. The left and right footwear carrying assemblies include first and second support straps each including a first end connected to the corresponding wider belt section and a free end. One of the first and second support straps includes a wider portion for extending about the footwear and a first fastener for cooperating with another fastener at the other of the first and second support straps.

BRIEF DESCRIPTION OF THE DRAWINGS

The above and other objects, advantages and novel features of the present invention will become apparent from the following detailed description of the preferred embodiment of the invention, illustrated in the accompanying drawings, in which.

DETAILED DESCRIPTION OF THE INVENTION

Figure 4:
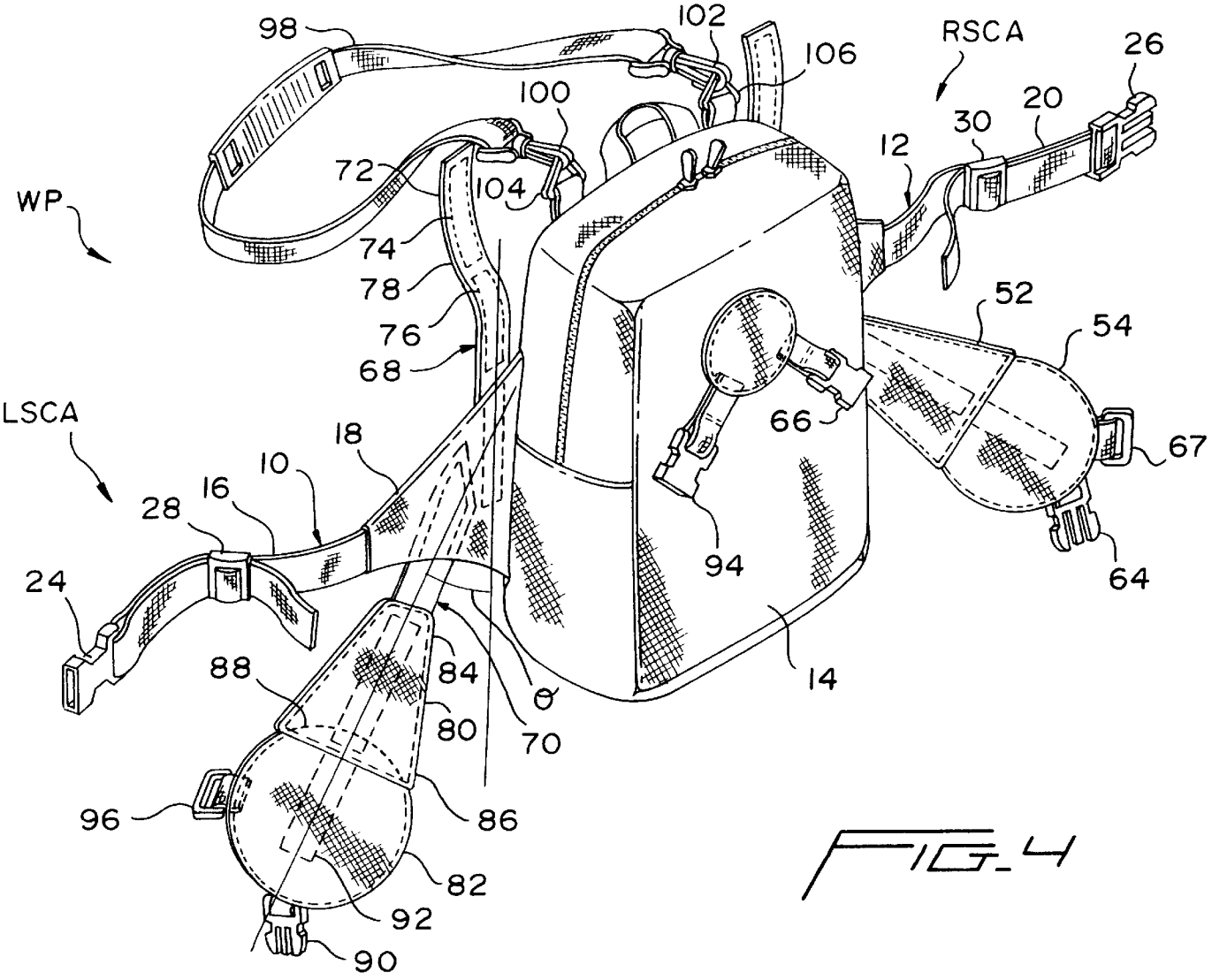
FIG. 4 is a rear perspective view of the waist pack of the invention shown in an extended position without the skates.

As best shown in FIG. 4, the waist pack WP of the invention includes left and right waist straps 10 and 12, respectively, each made of canvas, nylon or other suitable conventional material. A shoe container or compartment 14, preferably made of the same material as the straps 10 and 12, is provided between the left and right waist straps 10 and 12.

Figure 5:
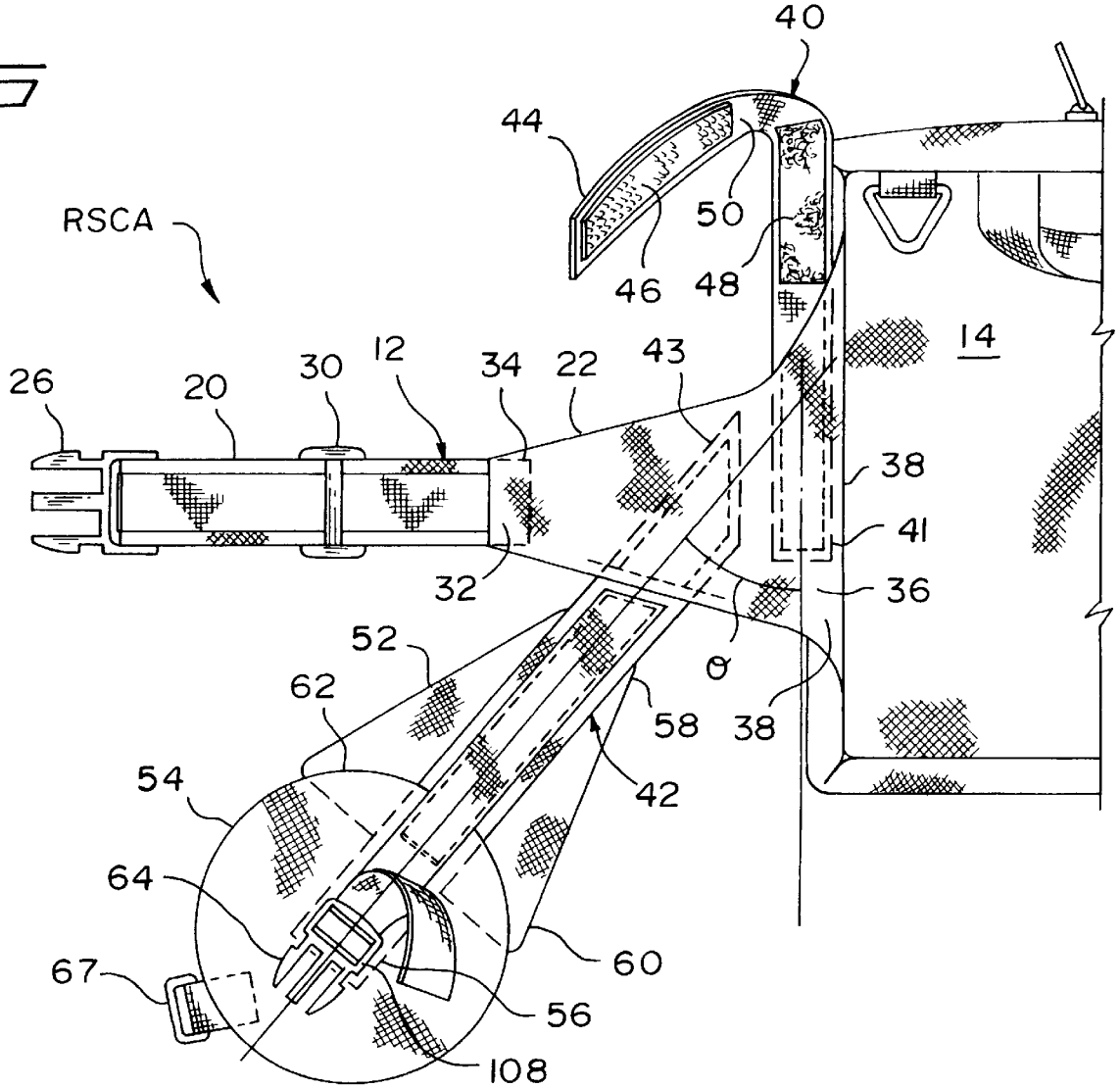
FIG. 5 is a partial enlarged front elevational view of the waist pack of the invention shown in an extended position.

The left waist strap 10 includes a narrow belt section 16 and a generally triangular wider belt section 18. In a similar fashion, the right waist strap 12 also includes a narrow belt section 20 and a generally triangular wider belt section 22 (FIG. 5). The left and right waist straps 10 and 12 include female and male latch members 24 and 26, respectively, that can be releasably interlocked together to wear the waist pack WP about the waist of a user U. The left and right waist straps 10 and 12 further include buckles 28 and 30 to allow the user U to adjust the lengths of the belt sections 16 and 20 about the waist. The narrow belt sections 16 and 20 are connected to the corresponding wider belt sections 18 and 22, and to the container 14, by stitching or other suitable conventional technique.

As further shown in FIG. 5, the wider belt section 22 of the right waist strap 12, includes an apex portion 32 interconnected to the end portion 34 of the narrow belt section 20. The base end portion 36 of the wider belt section 22 is connected to the right side portion 38 of the container 14. Upper and lower support straps 40 and 42 are connected to the wider belt section 22.

As best illustrated in FIG. 5, the upper support strap 40 extends vertically upwardly and generally parallel to the side portion 38 of the container 14, and includes a free end portion 44. Cooperating strips of VELCRO hooks 46 and loops 48 are provided on the same side 50 of the support strap 40.

Figure 1:
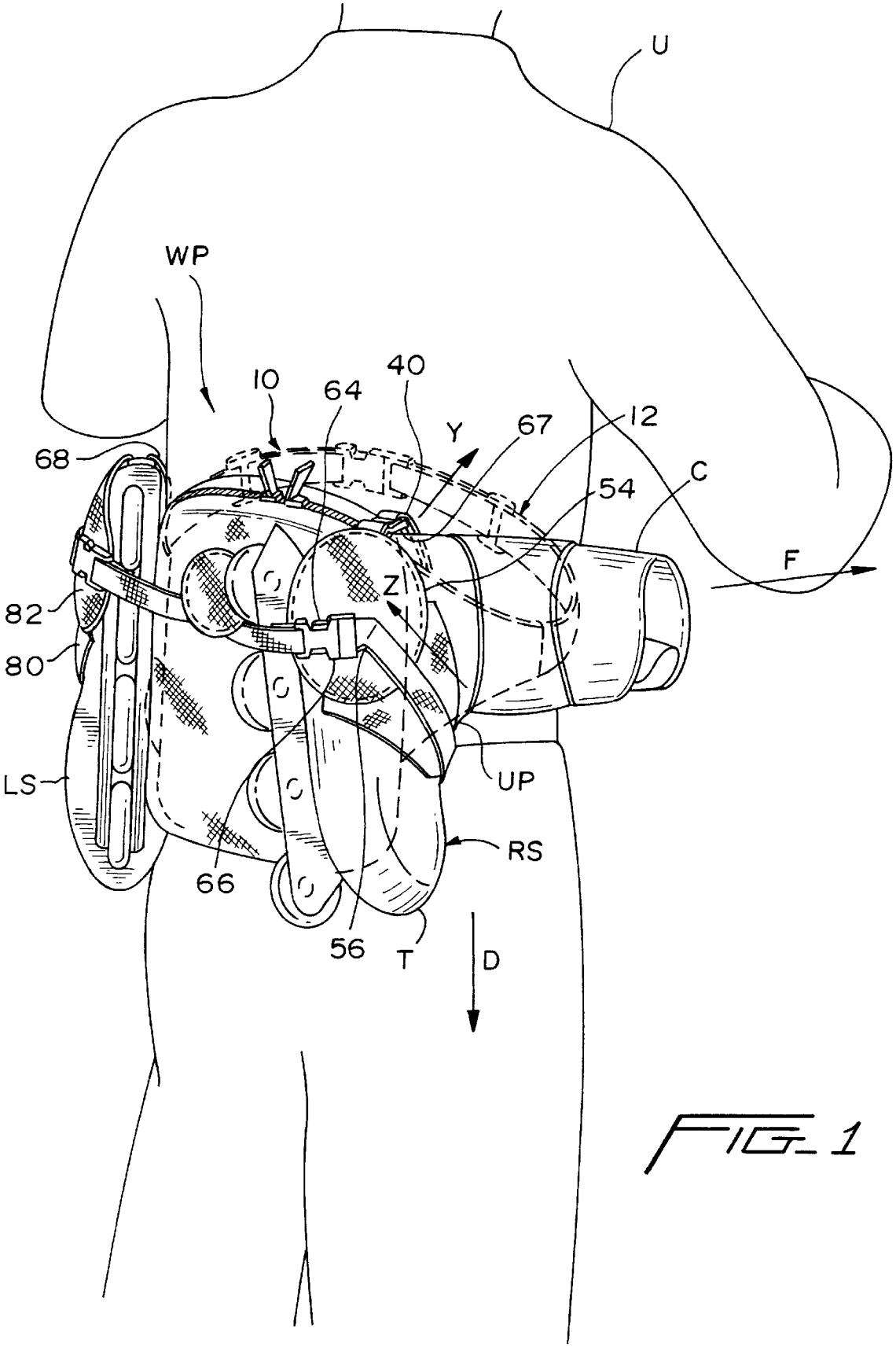
FIG. 1 is a rear perspective view of the waist pack of the present invention shown supported on the waist of a user.
Figure 2:
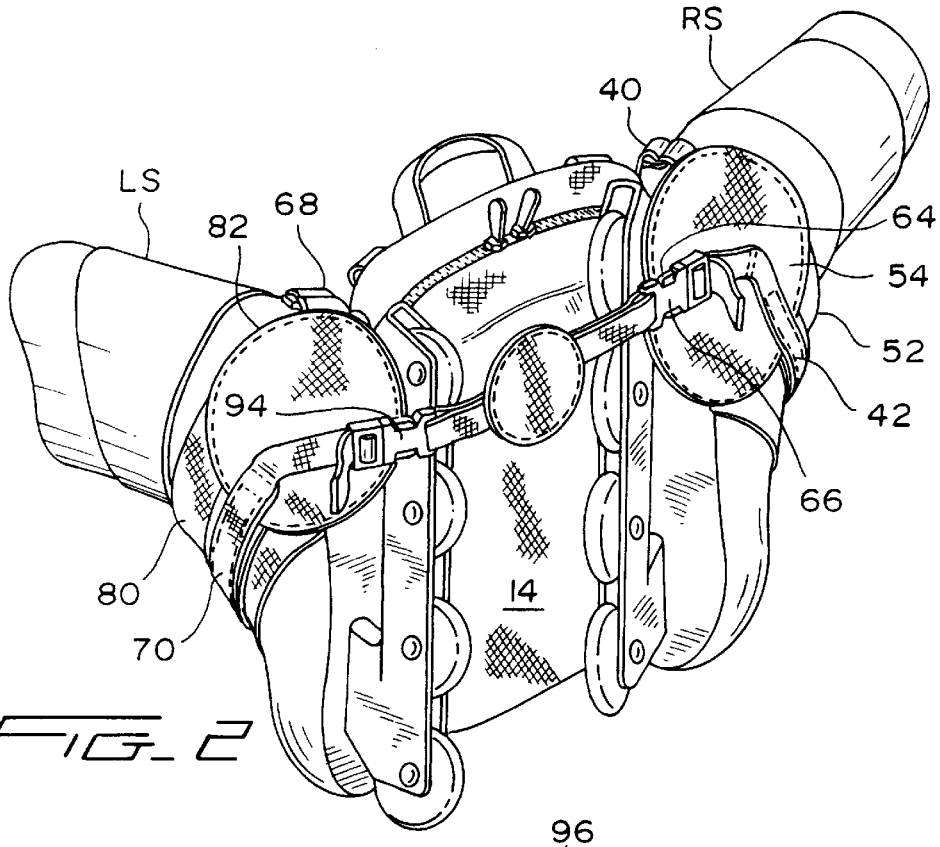
FIG. 2 is another rear perspective view of the waist pack of the invention shown with in-line skates.
Figure 3:
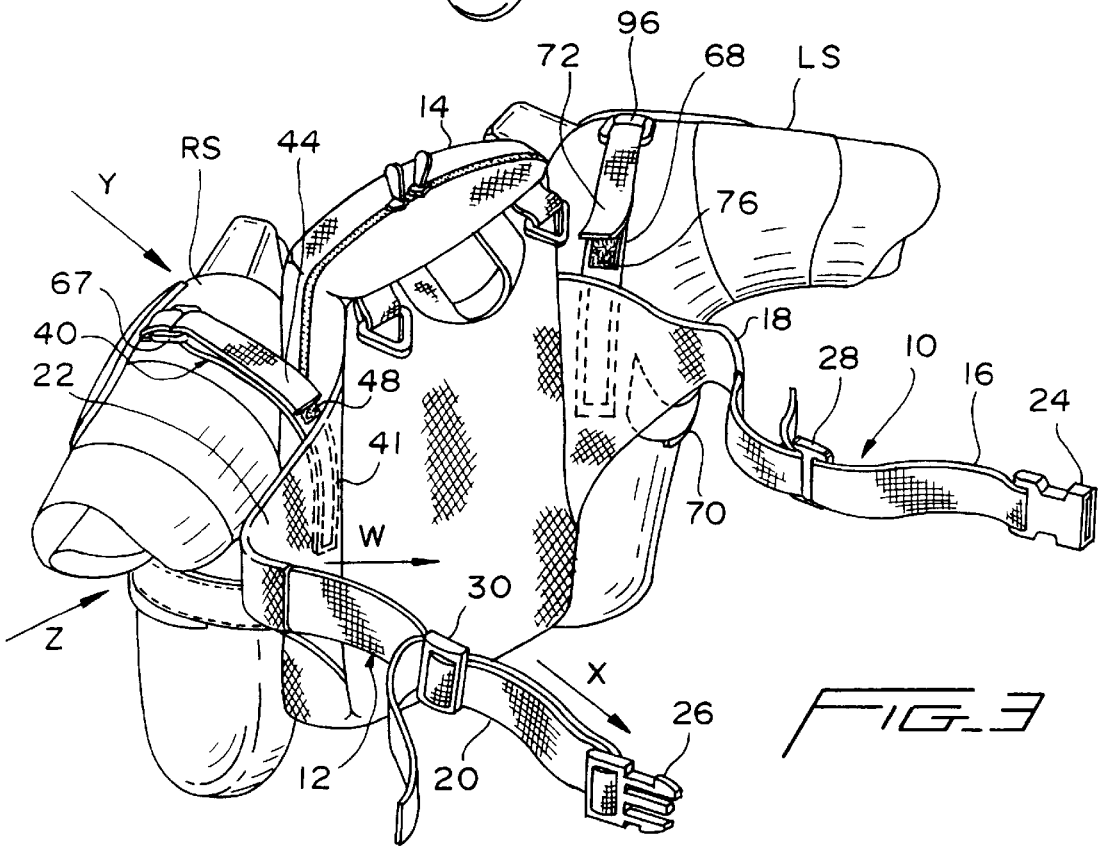
FIG. 3 is a front perspective view of the waist pack of the invention shown with in-line skates.

The lower support strap 42 extends downwardly in a direction generally opposite to the support strap 40, and at an angle θ of preferably about 30°–60°. The lower support strap 42 includes footwear engaging or anchoring members 52 and 54, and a free end portion 56. The anchoring member 52 is generally triangular in shape with its apex portion 58 facing the wider belt section 22, and the base portion 60 disposed away therefrom. The anchoring member 54 is generally round in configuration with a portion 62 overlapping with the base 60 of the anchoring member 52. The anchoring members 52 and 54 of the lower support strap 42 directly and positively engage the right skate RS for snugly supporting it on the waist of the user U (FIGS. 1–3).

The free end portion 56 of the lower support strap 42 includes a male latch 64 that cooperates with a female latch 66 anchored on the container 14 (FIG. 4). The round anchoring member 54 includes a loop member 67 to allow the upper support strap 40 to be threaded therethrough for further pulling and supporting the right skate RS on the waist pack WP and about the waist of the user (FIG. 3). The right waist strap 12, together with the upper and lower support straps 40 and 42, forms the right skate carrier assembly RSCA which is identical in structure and configuration to the left skate carrier assembly LSCA.

As best shown in FIG. 4, the left skate carrier assembly LSCA also includes upper and lower support straps 68 and 70, respectively. The upper support strap 68 includes a free end portion 72 with strips of VELCRO hooks and loops 74 and 76 provided on the side 78. A generally triangular footwear anchoring member 80 and a generally round anchoring member 82, are connected to the lower support strap 70. The apex portion 84 of the anchoring member 80 is adjacent the wider belt section 18 and the base 86 thereof lies away therefrom. The round anchoring member 82 includes a section 88 that overlaps with the base 86 of the footwear anchoring member 80. A male latch member 90 is provided at the free end portion 92 of the lower support strap 70. The male latch member 90 cooperates with a corresponding female latch member 94 on the container 14. A loop member 96 is provided on the round anchoring member 82 to allow the upper support strap 68 to be threaded therethrough for supporting the left skate LS on the waist of the user U (FIGS. 2–3). It is noted that the lower support strap 70 extends in a direction generally opposite to the upper support strap 68 and at an angle θ, similar to the structure and construction of the right skates carrier assembly RSCA.

A shoulder strap 98 is anchored on the container 14 by releasable latches 100 and 102 cooperating with loops 104 and 106, respectively.

Use and Operation

The use of the waist pack WP will now be described. In particular, the anchoring of the right skate RS by manipulating the right carrier assembly RSCA is described, keeping in mind that the anchoring of the left skate LS by the left carrier assembly LSCA would be similar.

As noted above, the user U, upon completion of a skating activity, would desire to switch to regular shoes being carried in the shoe container 14, and carry the left and right skates LS and RS, by the waist pack WP of the invention. At this time, the user U would be wearing the waist pack WP of the invention, about his or her waist by having previously adjusted the left and right waist straps 10 and 12, and interlocking them in the front by connecting the male and female latches 26 and 24, respectively.

In order to carry the right skate RS, the user would position the right skate RS over the wider belt section 22 in a manner that the toe portion T of the skate faces vertically downwardly and the cuff portion C thereof points towards the front of the user (see arrows D and F in FIG. 1). The lower support strap 42 is then wrapped around the upper UP of the right skate RS, until the free end portion 56 comes up and adjacent to the female latch 66 on the container 14. The male latch 64 on the lower support strap 42 is then interconnected with the female latch 66. It is noted that the length of the lower support strap 42 (FIG. 5), can be easily adjusted by manipulating the associated buckle 108 to accommodate various size skates.

Upon securing the lower support strap 42 snug and tight against the waist, the user U would then thread the upper support strap 40 through the loop 67 on the round anchoring member 54, and pull the free end portion 44 thereof towards the waist to interconnect the VELCRO strips 46 and 48 together to firmly secure and anchor the right skate RS against the waist (FIGS. 1, 3 and 5).

Figure 6:
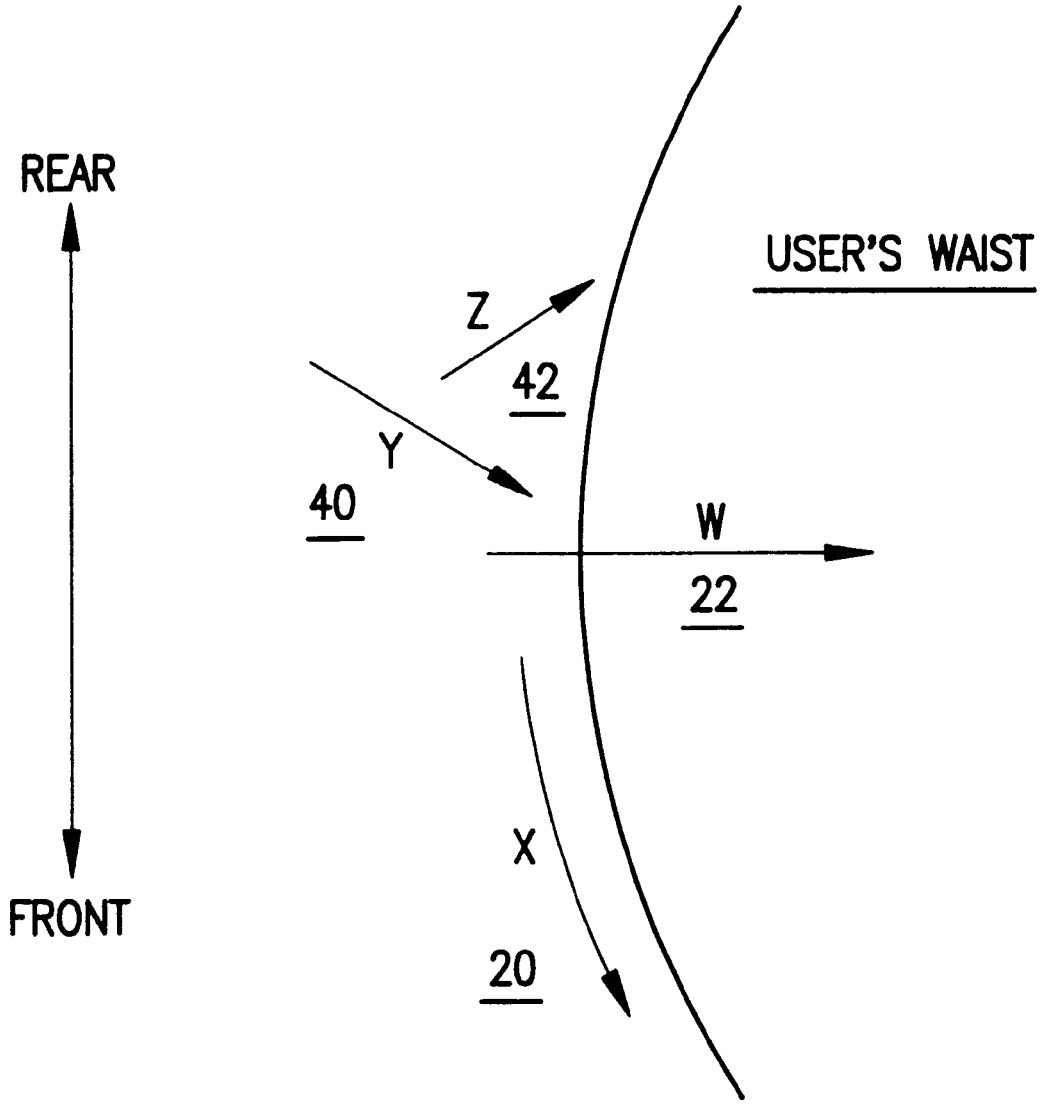
FIG. 6, s a schematic illustration of various pull forces exerted by various right side components of the waist pack of the invention about the waist of a user.

It is noted herewith that the upper and lower support straps 40 and 42 directly engage the right skate RS and pull it snugly against the user, as shown in FIGS. 1, 3 and 6, by arrows Y and Z, respectively. In addition, the right wider belt section 22, being already snug against the waist, further pulls the right skate RS towards the waist of the user (see arrow W in FIGS. 3 and 6), as the end portions 41 and 43 of the upper and lower straps 40 and 42, respectively, are anchored at the wider belt section 22 (FIG. 5). Moreover, since the narrow belt section 20 is fastened in the front of the user, the forward pull force of the narrow belt section 20 (shown by arrow X in FIGS. 3 and 6), further keeps the right skate RS snug against the waist of the user by virtue of being connected to the wider belt section 22. In this manner, a multi-directional equilibrium is created that keeps the right skate snug and secure directly against the waist of the user (see FIGS. 1 and 6). (It is noted herewith that the left skate carrier assembly LSCA would exert similar forces on the left side of the user's waist to carry the left skate LS.)

It can be observed from the above that since the upper and lower support straps forming a part of the carrier assembly, directly engage the skates and support it at various points about the waist of a user, the undesirable straddling of the skates is avoided. The skates are, therefore, carried snug and tight against the waist of user leading to better control and improved comfort.

While this invention has been described as having a preferred design, it is understood that it is capable of further modifications, uses and/or adaptations of the invention and including such departures from the present disclosure as those come within the known or customary practice in the art to which the invention pertains, and as may be applied to the central features hereinsetforth, and fall within the scope of the invention and of the limits of the appended claims.

What is claimed is:

1. A waist pack for carrying footwear, comprising:

a) a waist strap including left and right waist sections;

b) each of said left and right waist sections including a narrow belt section and a wider belt section;

c) left and right carrier means connected to the respective left and right waist sections for holding a footwear;

d) one of said left and right carrier means including first and second support straps;

e) each of said first and second support straps including a first end connected to the corresponding wider belt section and a free end; and f) one of said first and second support straps including a wider portion for securing about the footwear and first and second fasteners, said first fastener for cooperating with a corresponding fastener at the other of said first and second support straps and said second fastener for cooperating with a third fastener on the waist pack.

2. The waist pack of claim 1, wherein:

a) said wider belt section includes generally opposed edge portions; and b) said free ends of said first and second support straps extend away from each other.

3. The waist pack of claim 2, wherein:

a) said free ends of said first and second support straps extend in generally opposite directions.

4. The waist pack of claim 1, further comprising:

a) a container disposed between said left and right waist sections.

5. The waist pack of claim 4, wherein:

a) said wider belt section is located adjacent said container.

6. The waist pack of claim 4, further comprising:

a) a first reinforcement strap positioned on said container; and b) said reinforcement strap including said third fastener.

7. The waist pack of claim 6, wherein:

a) said second fastener cooperates with the third fastener.

8. The waist pack of claim 7, wherein:

a) said wider portion of said one of said first and second support straps includes a generally triangular panel and an adjacent generally round panel.

9. The waist pack of claim 8, wherein:

a) said triangular panel includes an apex portion positioned adjacent said wider belt section.

10. The waist pack of claim 1, further comprising:

a) a shoulder strap operably connected to said waist strap.

11. A waist pack for carrying in-line skates, comprising:

a) waist strap means including left and right waist sections;

b) each of said left and right waist sections including a narrow belt section and a wider belt section;

c) left and right carrier means connected to the wider belt section of the respective left and right waist sections for holding in-line skates;

d) each of said left and right carrier means including first and second support straps;

e) each of said first and second support straps including a first end connected to the corresponding wider belt section and a free end; and f) one of said first and second support straps including a wider portion for directly securing about an in-line skate and first and second fasteners, said first fastener for cooperating with a corresponding fastener at the other of said first and second support straps and said second fastener for cooperating with a third fastener on the waist pack.

12. The waist pack of claim 11, wherein:

a) said wider portion of said one of said first and second support straps tightly engages the in-line skate and the other of said first and second support straps pulls the in-line skate towards the waist of an user when said first and corresponding fastener cooperate with each other.

13. The waist pack of claim 12, further comprising:

a) a central waist section disposed between said left and right waist sections;

b) a reinforcement fastener positioned on said central waist section; and c) said second fastener cooperates with said reinforcement fastener to thereby pull the in-line skate towards the back of the user.

14. The waist pack of claim 13, wherein:

a) said left and right waist sections include cooperating fasteners to be interlocked about the front of the user;

b) wherein said left and right waist sections maintain the in-line skate substantially snug against the waist of the user when said cooperating fasteners thereof are interlocked.

15. The waist pack of claim 14, wherein:

a) said central waist section comprises a container.

16. The waist pack of claim 15, wherein:

a) said wider belt section is located adjacent said container.

17. The waist pack of claim 16, wherein:

a) said free ends of said first and second support straps extend in generally opposite directions.

18. The waist pack of claim 17, wherein:

a) said one of said first and second support straps extends at an angle relative to the other of said first and second support straps.

19. The waist pack of claim 18, wherein:

a) said wider portion of said one of said first and second support straps includes a generally triangular or generally round panel.

20. A waist pack for carrying footwear, comprising:

a) a waist strap including left and right waist sections;

b) each of said left and right waist sections including a narrow belt section and a wider belt section;

c) left and right carrier means connected to the respective left and right waist sections for holding footwear;

d) one of said left and right carrier means including first and second support straps;

e) said first and second support straps being operably couplable to each other; and f) one of said first and second support straps including a wider portion for securing about the footwear and a fastener for cooperating with a corresponding fastener on the waist pack.

* * * * *